US008203526B2

(12) United States Patent
Kawai

(10) Patent No.: US 8,203,526 B2
(45) Date of Patent: Jun. 19, 2012

(54) ELECTROPHORETIC DEVICE DRIVING METHOD, ELECTROPHORETIC DEVICE, ELECTRONIC APPARATUS, AND ELECTRONIC WATCH

(75) Inventor: Hideyuki Kawai, Fujimi (JP)

(73) Assignee: Seiko Epson Corporation (JP)

( * ) Notice: Subject to any disclaimer, the term of this patent is extended or adjusted under 35 U.S.C. 154(b) by 1280 days.

(21) Appl. No.: 11/461,535

(22) Filed: Aug. 1, 2006

(65) Prior Publication Data

US 2007/0046622 A1 Mar. 1, 2007

(30) Foreign Application Priority Data

Aug. 31, 2005 (JP) ..... 2005-250830

(51) Int. Cl.
*G09G 3/34* (2006.01)

(52) U.S. Cl. ..... 345/107; 345/84

(58) Field of Classification Search ..... 345/107, 345/84, 690; 359/296; 368/82
See application file for complete search history.

(56) References Cited

U.S. PATENT DOCUMENTS

| | | | | |
|---|---|---|---|---|
| 7,786,974 | B2 * | 8/2010 | Zhou et al. | 345/107 |
| 2002/0033784 | A1 * | 3/2002 | Machida et al. | 345/84 |
| 2003/0016590 | A1 * | 1/2003 | Brewer et al. | 368/82 |

FOREIGN PATENT DOCUMENTS

JP 2004-325489 11/2004

* cited by examiner

*Primary Examiner* — Quan-Zhen Wang
*Assistant Examiner* — Yuk Chow
(74) *Attorney, Agent, or Firm* — Harness, Dickey & Pierce, P.L.C.

(57) ABSTRACT

A driving method for driving an electrophoretic device that includes a display region including a plurality of electrophoretic elements each including a dispersed system that includes electrophoretic particles and that is disposed between a common electrode and a pixel electrode, a driver that drives the electrophoretic elements by applying voltages to the electrophoretic elements, and a controller that controls the driver, wherein two or more units of display rewritten at different rewrite intervals are provided in the display region includes controlling, by the controller, the driver to apply a higher voltage to an electrophoretic element included in a unit of display having a longer rewrite interval when an image is rewritten.

28 Claims, 5 Drawing Sheets

32

ELECTROPHORETIC DEVICE DRIVING METHOD, ELECTROPHORETIC DEVICE, ELECTRONIC APPARATUS, AND ELECTRONIC WATCH

BACKGROUND

1. Technical Field

The present invention relates to an electrophoretic device driving method, an electrophoretic device, and an electronic apparatus and an electronic watch that include the electrophoretic device.

2. Related Art

A phenomenon (electrophoretic phenomenon) is known in which the application of an electric field to a dispersed system including electrophoretic particles dispersed in a solution causes the electrophoretic particles to migrate due to the Coulomb force. Electrophoretic display devices utilizing such a phenomenon have been developed.

In such electrophoretic display devices, when a display state is maintained for a long period of time, electrophoretic particles may become adhered to an electrode or the like. Thus, the particles may move slowly when rewriting is performed, and a residual image may be generated. For example, when an electrophoretic display device is used for an electronic watch, a plurality of units of display, such as a month display, a date display, an hour display, a minute display, and a second display, are provided in a display region. Such units of display have greatly different rewrite intervals. For the month display and the date display, the same display is maintained for a long period of time. More specifically, for the month display, the same display is maintained for about 720 hours. For the date display, the same display is maintained for 24 hours. Thus, this circumstance is likely to generate residual images when the display is rewritten.

Generation of such residual images can be reduced, for example, by repeatedly performing display refreshing operations at short intervals, by applying a high voltage when rewriting is performed, or by applying a voltage for a long period of time when rewriting is performed. In addition, as a method for solving such problems, JP-A-2004-325489 discloses a method for applying a high-frequency voltage to a common electrode.

However, in a case where generation of residual images is reduced by applying a high voltage or applying a voltage for a long period of time when rewriting is performed, if a plurality of units of display having different rewrite intervals is provided in a display region of an electronic watch or the like, an unnecessary amount of voltage is consumed even for a unit of display, such as a minute display or a second display, which has a short rewrite interval and which is less likely to generate a residual image. In addition, if display refreshing operations are performed at the same interval for all the units of display, display refreshing operations are often performed unnecessarily for a unit of display, such as a month display or a date display, which has a long rewrite interval. Thus, increased electric power is consumed. In addition, if the method for applying a high-frequency voltage is adopted, a driving circuit becomes complicated, and power loss due to parasitic resistance of the wiring is increased.

SUMMARY

An advantage of the invention is that it provides an electrophoretic display device driving method for reducing the generation of a residual image while preventing unnecessary consumption of electric power.

A driving method according to a first aspect of the invention for driving an electrophoretic device including a display region including a plurality of electrophoretic elements each including a dispersed system that includes electrophoretic particles and that is disposed between a common electrode and a pixel electrode, a driver that drives the electrophoretic elements by applying voltages to the electrophoretic elements, and a controller that controls the driver, wherein two or more units of display rewritten at different rewrite intervals are provided in the display region, includes controlling, by the controller, the driver to apply a higher voltage to an electrophoretic element included in a unit of display having a longer rewrite interval when an image is rewritten.

With this arrangement, by applying a higher voltage to an electrophoretic element included in a unit of display, such as a month display or a date display of an electronic watch or the like, which has a longer rewrite interval and which is likely to generate a residual image, the generation of a residual image can be reduced. In contrast, for a unit of display, such as a minute display or a second display, which has a shorter rewrite interval, unnecessary power consumption can be avoided. In addition, since applying a higher voltage causes electrophoretic particles to be deposited on an electrode more densely, a unit of display having a long rewrite interval can achieve excellent display for a long period of time.

A driving method according to a second aspect of the invention for driving an electrophoretic device including a display region including a plurality of electrophoretic elements each including a dispersed system that includes electrophoretic particles and that is disposed between a common electrode and a pixel electrode, a driver that drives the electrophoretic elements by applying voltages to the electrophoretic elements, and a controller that controls the driver, wherein two or more units of display rewritten at different rewrite intervals are provided in the display region, includes controlling, by the controller, the driver to apply a voltage to an electrophoretic element included in a unit of display having a longer rewrite interval for a longer period of time when an image is rewritten.

With this arrangement, by applying a voltage to an electrophoretic element included in a unit of display that has a longer rewrite interval and that is likely to generate a residual image for a longer period of time, the generation of a residual image can be reduced. In contrast, for a unit of display, such as a minute display or a second display, which has a shorter rewrite interval, unnecessary power consumption can be avoided. In addition, since applying a voltage for a longer period of time causes electrophoretic particles to be deposited on an electrode more densely, a unit of display having a long rewrite interval can achieve excellent display for a long period of time.

In addition, in the driving method for driving the electrophoretic device, the voltage may be applied to the electrophoretic element included in the unit of display having the longer rewrite interval for the longer period of time by dividing the voltage into a plurality of pulses and by applying an increased number of pulses to the electrophoretic element. With this arrangement, voltages can be applied to electrophoretic elements for different periods of time using a simple circuit.

In addition, applying a higher voltage to an electrophoretic element included in a unit of display having a longer rewrite interval for a longer period of time is also within the scope of the invention.

A driving method according to a third aspect of the invention for driving an electrophoretic device including a display region including a plurality of electrophoretic elements each including a dispersed system that includes electrophoretic particles and that is disposed between a common electrode and a pixel electrode, a driver that drives the electrophoretic elements by applying voltages to the electrophoretic elements, and a controller that controls the driver, wherein two or more units of display rewritten at different rewrite intervals are provided in the display region, includes controlling, by the controller, the driver to apply a voltage only to an electrophoretic element included in a unit of display having a rewrite interval that is longer than a predetermined period of time and to perform a display refreshing operation for the unit of display.

Here, the "display refreshing operation" means regularly or irregularly applying a voltage based on image data in order to stabilize or maintain a distribution state of electrophoretic particles distributed so as to display a desired image by application of a voltage. Thus, the "display refreshing operation" is different from a known "refreshing operation" constituted by data deletion and writing performed in a liquid crystal display device. Data deletion is not necessarily performed in the "display refreshing operation" in this aspect of the invention.

With this arrangement, by performing a display refreshing operation only for a unit of display having a rewrite interval that is longer than a predetermined period of time and being likely to generate a residual image, the generation of a residual image can be reduced. A constant display refreshing interval may be set for all the units of display having rewrite intervals longer than the predetermined period of time. Alternatively, display refreshing operations may be performed at different intervals depending on the units of display. In contrast, for a unit of display, such as a minute display or a second display, which has a shorter rewrite interval, unnecessary power consumption can be prevented without performing a refreshing operation.

In the driving method for driving the electrophoretic device, the display refreshing operation may be repeatedly performed, and the display refreshing operation may be performed at an interval that is shorter than a period of time in which the display holding performance of the dispersed system is reduced to an unacceptable level. With this arrangement, the display performance can always be maintained within an acceptable range. By setting a display refreshing interval to be slightly shorter than a period of time in which the display holding performance of the dispersed system is reduced to an unacceptable level, the number of refreshing times can be reduced to a minimum. Thus, unnecessary power consumption can be avoided.

In the driving method for driving the electrophoretic device, the display refreshing operation may be repeatedly performed. In each display refreshing operation, a sufficiently high voltage may be applied such that the display holding performance of the dispersed system is not reduced to an unacceptable level before the next display refreshing operation is performed. With this arrangement, the display performance can always be maintained within an acceptable range. By setting a voltage to be applied to a minimum within the range in which the display performance is not reduced to an unacceptable level before the next display refreshing operation is performed, unnecessary power consumption can be avoided.

In the driving method for driving the electrophoretic device, the display refreshing operation may be repeatedly performed. In each display refreshing operation, a voltage may be applied for a sufficiently long period of time such that the display holding performance of the dispersed system is not reduced to an unacceptable level before the next display refreshing operation is performed. With this arrangement, the display performance can always be maintained within an acceptable range. By applying a voltage for the minimum period of time within the range in which the display performance is not reduced to an unacceptable level before the next display refreshing operation is performed, unnecessary power consumption can be avoided.

An electrophoretic device according to a fourth aspect of the invention includes a display region including a plurality of electrophoretic elements each including a dispersed system that includes electrophoretic particles and that is disposed between a common electrode and a pixel electrode, a driver that drives the electrophoretic elements by applying voltages to the electrophoretic elements, and a controller that controls the driver. Two or more units of display rewritten at different rewrite intervals are provided in the display region. When rewriting is performed, the controller controls the driver to apply a higher voltage to an electrophoretic element included in a unit of display having a longer rewrite interval.

With this arrangement, by applying a higher voltage to an electrophoretic element included in a unit of display, such as a month display or a date display of an electronic watch or the like, which has a longer rewrite interval and which is likely to generate a residual image, the generation of a residual image can be reduced. In contrast, for a unit of display, such as a minute display or a second display, which has a shorter rewrite interval, unnecessary power consumption can be avoided. In addition, since applying a higher voltage causes electrophoretic particles to be deposited on an electrode more densely, excellent display can be achieved for a long period of time.

An electrophoretic device according to a fifth aspect of the invention includes a display region including a plurality of electrophoretic elements each including a dispersed system that includes electrophoretic particles and that is disposed between a common electrode and a pixel electrode, a driver that drives the electrophoretic elements by applying voltages to the electrophoretic elements, and a controller that controls the driver. Two or more units of display rewritten at different rewrite intervals are provided in the display region. When rewriting is performed, the controller controls the driver to apply a voltage to an electrophoretic element included in a unit of display having a longer rewrite interval for a longer period of time.

With this arrangement, by applying a voltage to an electrophoretic element included in a unit of display that has a longer rewrite interval and that is likely to generate a residual image for a longer period of time, the generation of a residual image can be reduced. In contrast, for a unit of display, such as a minute display or a second display, which has a shorter rewrite interval, unnecessary power consumption can be avoided. In addition, since applying a voltage for a longer period of time causes electrophoretic particles to be deposited on an electrode more densely; excellent display can be achieved for a long period of time.

In addition, when a voltage is applied for a longer period of time, the width of a driving pulse (voltage application time) may be set to be larger (longer). Alternatively, a driving pulse may be divided into a plurality of pulses and an increased number of pulses may be applied, so that the total voltage application time can be increased.

In addition, a device controlled such that a higher voltage is applied to an electrophoretic element included in a unit of display having a longer rewrite interval for a longer period of time is also within the scope of the invention.

An electrophoretic device according to a sixth aspect of the invention includes a display region including a plurality of electrophoretic elements each including a dispersed system that includes electrophoretic particles and that is disposed between a common electrode and a pixel electrode, a driver that drives the electrophoretic elements by applying voltages to the electrophoretic elements, and a controller that controls the driver. Two or more units of display rewritten at different rewrite intervals are provided in the display region, and the controller controls the driver to apply a voltage only to an electrophoretic element included in a unit of display having a rewrite interval that is longer than a predetermined period of time and to perform a display refreshing operation for the unit of display.

Here, the "display refreshing operation" means regularly or irregularly applying a voltage based on image data in order to stabilize or maintain a distribution state of electrophoretic particles distributed so as to display a desired image by application of a voltage. Thus, the "display refreshing operation" is different from a known "refreshing operation" constituted by data deletion and writing performed in a liquid crystal display device. Data deletion is not necessarily performed in the "display refreshing operation" in this aspect of the invention.

With this arrangement, by performing a display refreshing operation only for a unit of display having a rewrite interval that is longer than a predetermined period of time and being likely to generate a residual image, the generation of a residual image can be reduced. A constant display refreshing interval may be set for all the units of display having rewrite intervals longer than the predetermined period of time. Alternatively, display refreshing operations may be performed at different intervals depending on the units of display. In contrast, for a unit of display, such as a minute display or a second display, which has a shorter rewrite interval, unnecessary power consumption can be prevented without performing a refreshing operation.

In the electrophoretic device, the display refreshing operation may be repeatedly performed, and the display refreshing operation may be performed at an interval that is shorter than a period of time in which the display holding performance of the dispersed system is reduced to an unacceptable level. With this arrangement, the display performance can always be maintained within an acceptable range. By setting a display refreshing interval to be slightly shorter than a period of time in which the display holding performance of the dispersed system is reduced to an unacceptable level, the number of refreshing times can be reduced to a minimum. Thus, unnecessary power consumption can be avoided.

In the electrophoretic device, the display refreshing operation may be repeatedly performed. In each display refreshing operation, a sufficiently high voltage may be applied such that the display holding performance of the dispersed system is not reduced to an unacceptable level before the next display refreshing operation is performed. With this arrangement, the display performance can always be maintained within an acceptable range. By setting a voltage to be applied to a minimum within the range in which the display performance is not reduced to an unacceptable level before the next display refreshing operation is performed, unnecessary power consumption can be avoided.

In the electrophoretic device, the display refreshing operation may be repeatedly performed. In each display refreshing operation, a voltage may be applied for a sufficiently long period of time such that the display holding performance of the dispersed system is not reduced to an unacceptable level before the next display refreshing operation is performed. With this arrangement, the display performance can always be maintained within an acceptable range. By applying a voltage for the minimum period of time within the range in which the display performance is not reduced to an unacceptable level before the next display refreshing operation is performed, unnecessary power consumption can be avoided.

An electronic apparatus according to an aspect of the invention includes the foregoing electrophoretic device as a display section. The "electronic apparatus" may be any apparatus including a display section adopting display using an electrophoretic material. The "electronic apparatus" may be a display apparatus, a television apparatus, electronic paper, a watch, an electronic calculator, a cellular phone, a portable information terminal, or the like. In addition, although deviating from the concept of an "apparatus", for example, the "electronic apparatus" may be flexible paper or film, an object belonging to a fixed property, such as a wall surface, to which such paper or film is attached, or an object belonging to a moving body, such as a vehicle, a flying vehicle, or a ship.

An electronic watch according to an aspect of the invention includes the foregoing electrophoretic device as a display section, and the two or more units of display are selected from a group including a month display, a date display, an hour display, a minute display, and a second display. Even if such an electronic watch has units of display having largely different rewrite intervals, the generation of a residual image can be efficiently reduced without wasting electric power.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described.

Figure 1:
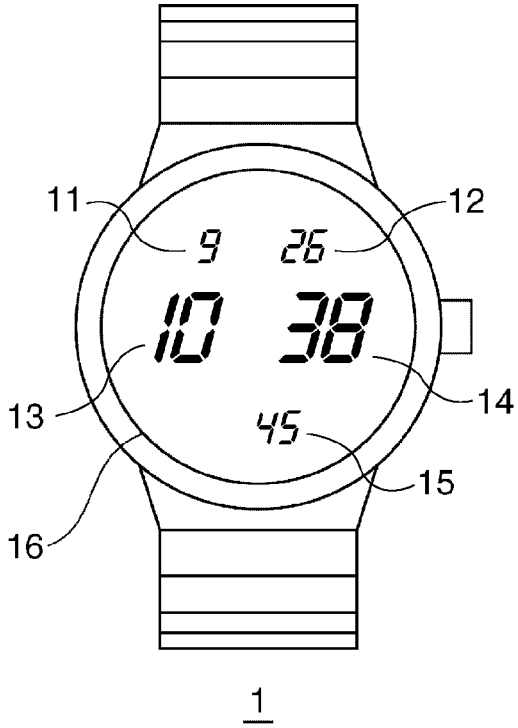
FIG. 1 shows an electronic watch including an electrophoretic device according to an embodiment of the invention.

FIG. 1 shows an electronic watch 1 as an example of an electronic apparatus including an electrophoretic device according to an embodiment of the invention. The electrophoretic device contained within the electronic watch 1 is driven in accordance with an electrophoretic device driving method according to an embodiment of the invention. As shown in FIG. 1, the electronic watch 1 includes a display region 16. The display region 16 includes five units of display including a month display 11, a date display 12, an hour display 13, a minute display 14, and a second display 15. In FIG. 1, the electronic watch 1 indicates that the time is 10:38:45 and the date is September 26.

Figure 2:
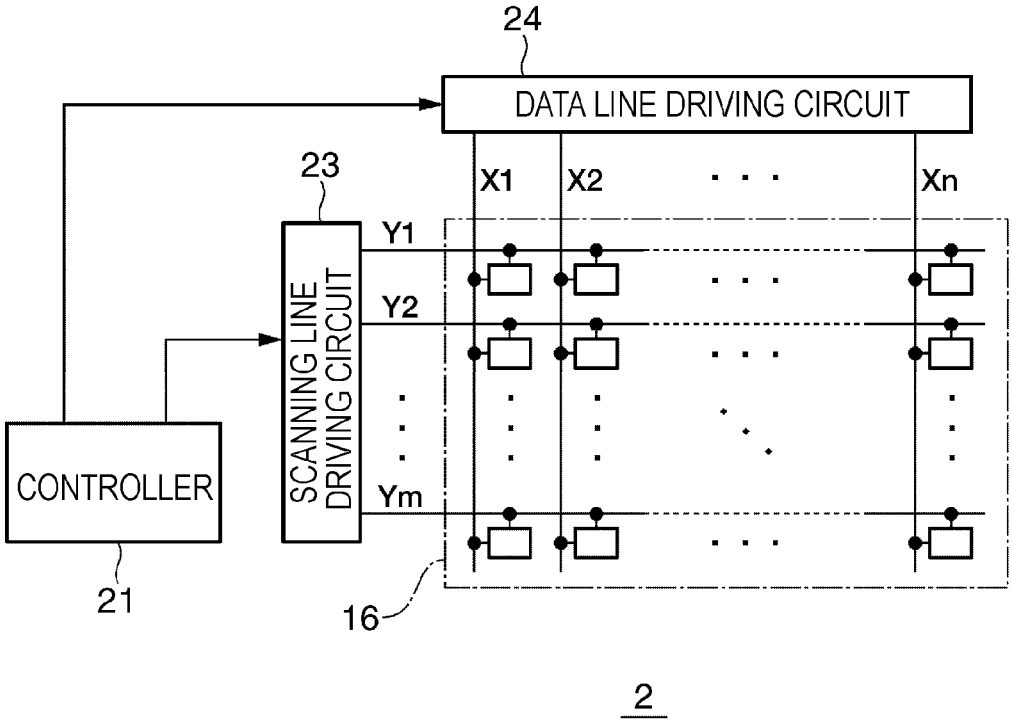
FIG. 2 is a block diagram showing the circuit structure of the electrophoretic device according to the embodiment of the invention.

FIG. 2 is a block diagram schematically showing the circuit structure of an electrophoretic device 2 contained within the electronic watch 1. The electrophoretic device 2 includes a controller 21, the display region 16, a scanning line driving circuit 23, and a data line driving circuit 24.

The controller 21 controls the scanning line driving circuit 23 and the data line driving circuit 24. The controller 21 includes an image signal processing circuit, a timing generator, and the like, which are not shown in FIG. 2. The controller 21 generates image signals (image data) indicating images displayed in the display region 16, reset data for performing resetting when images are rewritten, and various other signals (clock signals and the like), and outputs such data and signals to the scanning line driving circuit 23 or the data line driving circuit 24.

The display region 16 includes a plurality of data lines disposed in parallel in an X direction, a plurality of scanning lines disposed in parallel in a Y direction, and a plurality of pixel circuits disposed at the intersections of the data lines and the scanning lines. An electrophoretic element contained in each of the pixel circuits performs image display.

The scanning line driving circuit 23 is connected to each of the scanning lines in the display region 16. The scanning line driving circuit 23 selects one of the scanning lines and supplies a predetermined scanning line signal Y1, Y2, . . . , or Ym to the selected scanning line. The scanning line signals Y1, Y2, . . . , and Ym are signals for sequentially shifting an active period (H-level period). The scanning line signals Y1, Y2, . . . , and Ym output to the corresponding scanning lines cause pixel circuits connected to the scanning lines to be turned on sequentially.

The data line driving circuit 24 is connected to each of the data lines in the display region 16. The data line driving circuit 24 supplies a data signal X1, X2, . . . , or Xn to a pixel circuit selected by the scanning line driving circuit 23.

Figure 3:
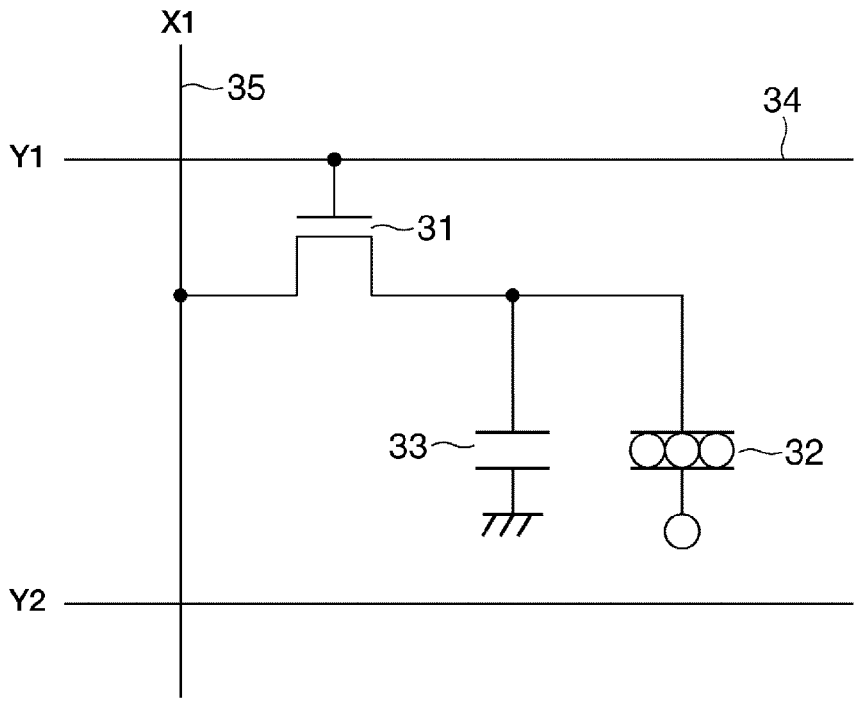
FIG. 3 is a circuit diagram showing the structure of each pixel circuit of the electrophoretic device according to the embodiment of the invention.

FIG. 3 is a circuit diagram showing the structure of a pixel circuit. Referring to FIG. 3, the pixel circuit includes a switching transistor 31, an electrophoretic element 32, and a hold capacitor 33. The switching transistor 31 is, for example, an N-channel transistor. The gate of the transistor 31 is connected to a scanning line 34, the source of the transistor 31 is connected to a data line 35, and the drain of the transistor 31 is connected to a pixel electrode of the electrophoretic element 32. The electrophoretic element 32 includes a dispersed system disposed between a common electrode and the pixel electrode. The hold capacitor 33 is connected in parallel with the electrophoretic element 32.

Figure 4:
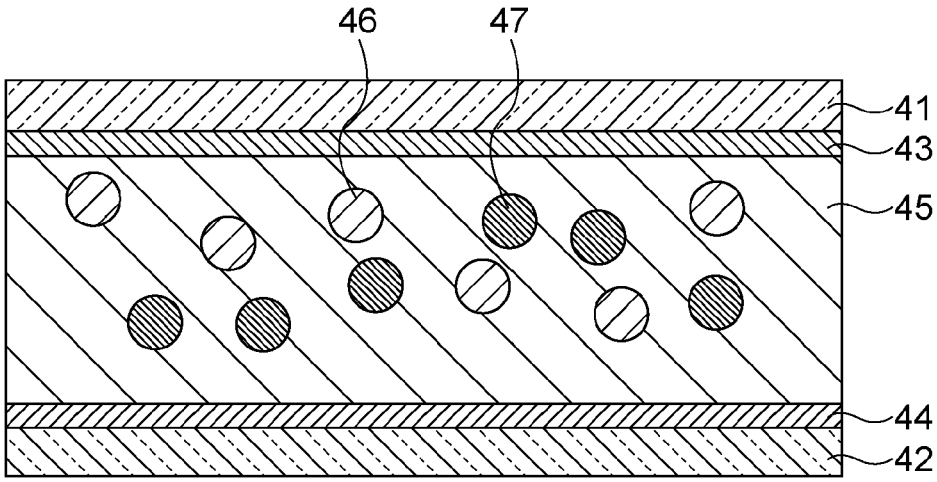
FIG. 4 is schematic cross-sectional diagram showing an example of the structure of an electrophoretic element.

FIG. 4 is a schematic cross-sectional diagram showing an example of the structure of the electrophoretic element 32. Referring to FIG. 4, the electrophoretic element 32 used in this embodiment includes a dispersed system 45 disposed between a pixel electrode 43 formed on a substrate 41 made of glass, resin, or the like and a common electrode 44 formed on a substrate 42 made of glass, resin, or the like. The dispersed system 45 includes electrophoretic particles 46 and 47. In this embodiment, the electrophoretic particles 46 are white particles and are negatively charged, and the electrophoretic particles 47 are black particles and are positively charged. By controlling the voltage applied between the pixel electrode 43 and the common electrode 44, the spatial arrangement of the electrophoretic particles 46 and 47 is changed. Thus, white or black is displayed.

In the electrophoretic element 32, for example, when a low power supply potential Vss (for example, 0 V) is applied to the pixel electrode 43 via a data line and a high power supply potential Vdd (for example, +10 V) is applied as the potential (common potential) Vcom of the common electrode 44, the white electrophoretic particles 46 move toward the common electrode 44 and the black electrophoretic particles 47 move toward the pixel electrode 43. Thus, when viewed from the common electrode 44 (from the bottom of FIG. 4), white is displayed. In contrast, when the lower power supply potential Vss is applied as the common potential Vcom and the high power supply potential Vdd is applied to the pixel electrode 43, the black electrophoretic particles 47 move toward the common electrode 44 and the white electrophoretic particles 46 move toward the pixel electrode 43. Thus, when viewed from the common electrode 44, black is displayed.

A specific driving method for driving the electrophoretic device 2 contained in the electronic watch 1 is described next. In the electrophoretic device 2 according to this embodiment, in order to rewrite an image, the controller 21 controls the scanning line driving circuit 23 and the data line driving circuit 24 to apply voltages to the common electrode 44 and the pixel electrode 43 of each of the electrophoretic elements 32. The controller 21 is capable of controlling a voltage to be applied to the electrophoretic element 32 included in each of the month display 11, the date display 12, the hour display 13, the minute display 14, and the second display 15, individually.

Figure 5:
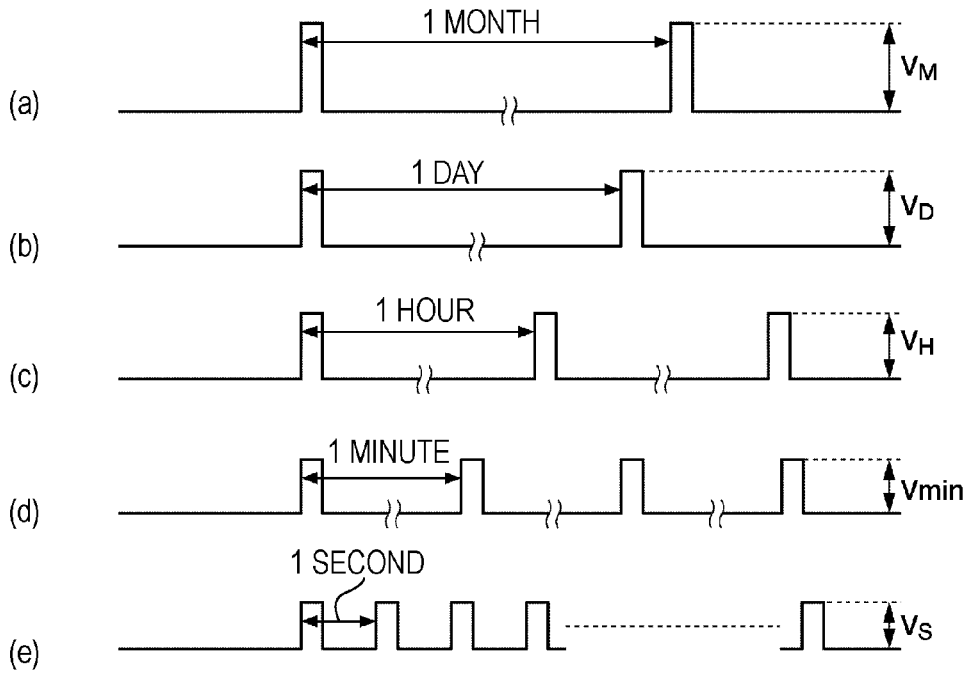
FIG. 5 includes waveform charts for explaining an example of an electrophoretic device driving method according to an embodiment of the invention.

Parts (a) to (e) of FIG. 5 are waveform charts for explaining a driving method according to an embodiment of the invention for driving the electronic watch 1.

As shown in part (a) of FIG. 5, in order to rewrite the display, the controller 21 controls, every single month, the scanning line driving circuit 23 and the data line driving circuit 24 to apply a voltage to the month display 11, and changes display. The voltage applied to the month display 11 is represented by $V_M$. Similarly, a voltage used for rewriting the display is applied, every single day, to the date display 12. The voltage applied to the date display 12 is represented by $V_D$. A voltage used for rewriting the display is applied, every single hour, to the hour display 13. The voltage applied to the hour display 13 is represented by $V_H$. A voltage used for rewriting the display is applied, every single minute, to the minute display 14. The voltage applied to the minute display 14 is represented by $V_{min}$. A voltage used for rewriting the display is applied, every single second, to the second display 15. The voltage applied to the second display 15 is represented by $V_S$.

The controller 21 controls the scanning line driving circuit 23 and the data line driving circuit 24 such that a higher voltage is applied to the electrophoretic element 32 included in a unit of display having a longer rewrite interval, such as the month display 11 or the date display 12. That is, the controller 21 controls the scanning line driving circuit 23 and the data line driving circuit 24 such that the relationship between the applied voltages satisfies the condition $V_M \geqq V_D \geqq V_E \geqq V_{min} \geqq V_S$. The size of each of the voltages is not particularly limited as long as the condition $V_M \geqq V_D \geqq V_H \geqq V_{min} \geqq V_S$ is satisfied. For example, the relationship between the voltages may be represented by the condition $V_m > V_D > V_H > V_{min} > V_S$. Alternatively, for example, the relationship between the voltages may be represented by the condition $V_M = V_D > V_H > V_{min} = V_S$.

Under such control, a high voltage is applied to a unit of display that has a long rewrite interval and that is likely to generate a residual image. Thus, even if electrophoretic particles are adhered to an electrode or the like, the electrophoretic particles can be moved so as to achieve display of the next image without generating a residual image. In addition, since applying a high voltage when rewriting is performed causes electrophoretic particles to be densely deposited on an electrode, excellent display can be maintained over a long period of time even without performing display refreshing. In contrast, a low voltage, which is sufficient for rewriting the display, can be applied to a unit of display, such as the minute display 14 or the second display 15, which does not need to maintain display for a long period of time and which is less likely to cause adhesion of electrophoretic particles. Thus, power consumption can be reduced.

Figure 6:
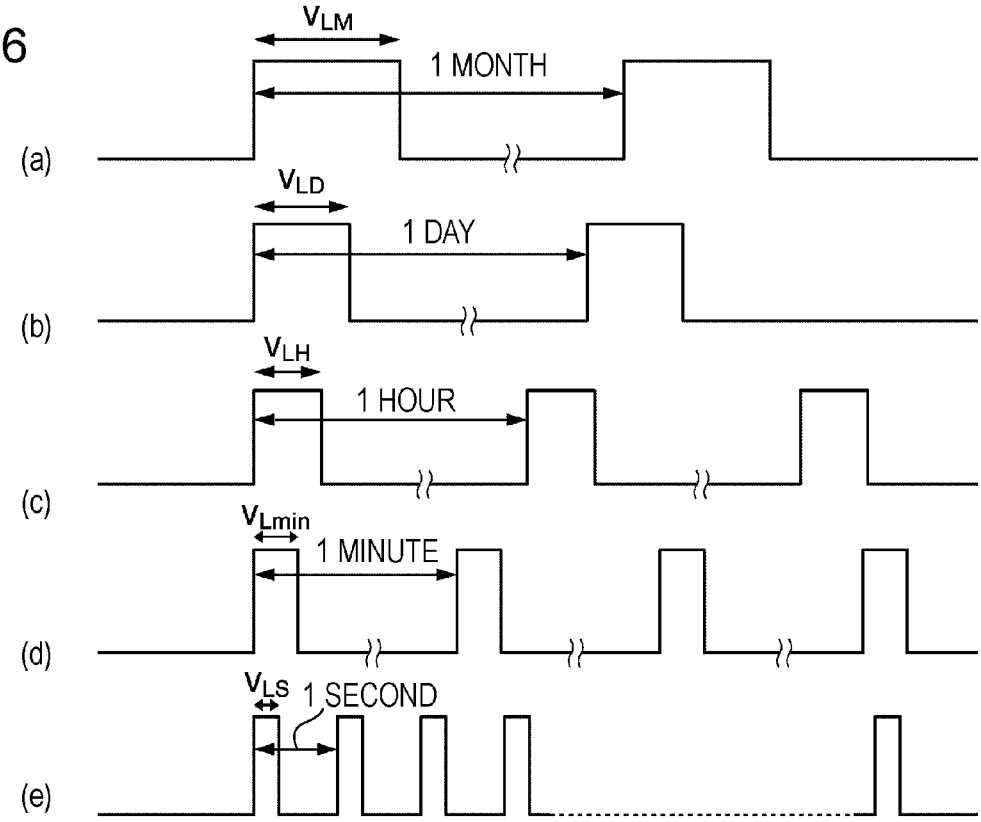
FIG. 6 includes waveform charts for explaining an example of an electrophoretic device driving method according to another embodiment of the invention.

Parts (a) to (e) of FIG. 6 are waveform charts for explaining a driving method according to another embodiment of the invention for driving the electronic watch 1.

The controller 21 controls the scanning line driving circuit 23 and the data line driving circuit 24 to apply, every single month, a voltage to the month display 11 for an application time $V_{LM}$, to apply, every single day, a voltage to the date display 12 for an application time $V_{LD}$, to apply, every single hour, a voltage to the hour display 13 for an application time $V_{LH}$, to apply, every single minute, a voltage to the minute display 14 for an application time $V_{Lmin}$, and to apply, every single second, a voltage to the second display 15 for an application time $V_{LS}$.

The controller 21 applies a voltage to the electrophoretic element 32 included in a unit of display, such as the month display 11 or the date display 12, which has a longer rewrite interval, for a longer period of time. That is, the controller 21 controls the voltages to have a relationship satisfying the condition $V_{LM} \geqq V_{LD} \geqq V_{LH} \geqq V_{Lmin} \geqq V_{LS}$. The size of each of the voltages is not particularly limited as long as the condition $V_{LM} \geqq V_{LD} \geqq V_{LH} \geqq V_{Lmin} \geqq V_{LS}$ is satisfied. For example, the relationship between the voltages may be represented by the condition $V_{LM} > V_{LD} > V_{LH} > V_{Lmin} \geqq V_{LS}$. Alternatively, for example, the relationship between the voltages may be represented by the condition $V_{LM} = V_{LD} > V_{LH} > V_{Lmin} = V_{LS}$.

Under such control, a voltage is applied to a unit of display that has a longer rewrite interval and that is likely to generate a residual image for a longer period of time. Thus, even if electrophoretic particles are adhered to an electrode or the like, the electrophoretic particles can be moved so as to achieve display of the next image without generating a residual image. In addition, since applying a voltage for a long period of time when rewriting is performed causes electrophoretic particles to be densely deposited on an electrode, excellent display can be maintained over a long period of time even without performing display refreshing. In contrast, a voltage is applied, for a short period of time, to a unit of display, such as the minute display 14 or the second display 15, which does not need to maintain display for a long period of time and which is less likely to cause adhesion of electrophoretic particles. Thus, power consumption can be reduced.

Figure 7:
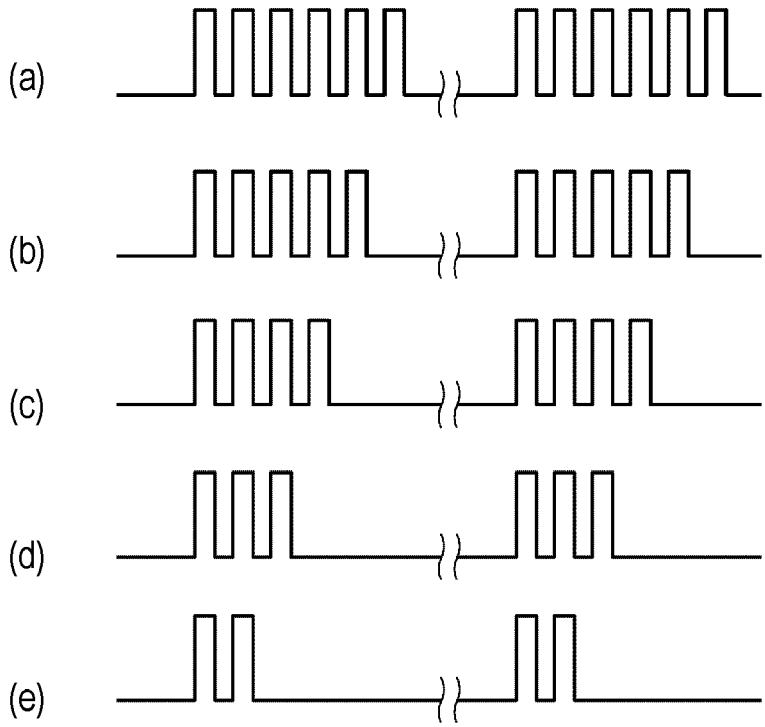
FIG. 7 includes waveform charts for explaining an example of an electrophoretic device driving method according to another embodiment of the invention.

In order to apply a voltage for a longer period of time, the width of a driving pulse may be changed, as shown in part (a) to (e) of FIG. 6. Alternatively, a driving pulse may be divided into a plurality of pulses, and the plurality of pulses may be applied, as shown in part (a) to (e) of FIG. 7. In this case, by increasing the number of pulses, a voltage application time is increased. In order to change the length of a one-shot pulse, the controller 21 needs to be provided with a timer for counting time and an analog circuit, such as a digital-to-analog (D/A) converter. However, if the procedure for changing the number of fixed-width pulses is adopted, it is only necessary to count the number of pulses. Thus, a simpler circuit configuration including only a digital circuit can be achieved.

In addition, applying a higher voltage to a unit of display having a longer rewrite interval for a longer period of time is also within the scope of the invention.

In the electronic watch 1 according to another embodiment of the invention, the controller 21 applies a voltage only to an electrophoretic element included in a unit of display having a rewrite interval that is longer than a predetermined period of time and performs display refreshing for the unit of display regularly or irregularly. For example, if the predetermined period of time is set to twelve hours, display refreshing is performed only for the month display 11 and the date display 12. A single display refreshing operation may be performed. Alternatively, display refreshing operations may be repeatedly performed. In addition, display refreshing operations may be performed for the month display 11 and the date display 12 at the same time. Alternatively, display refreshing operations may be performed for the month display 11 and the date display 12 at different timings.

Figure 8:
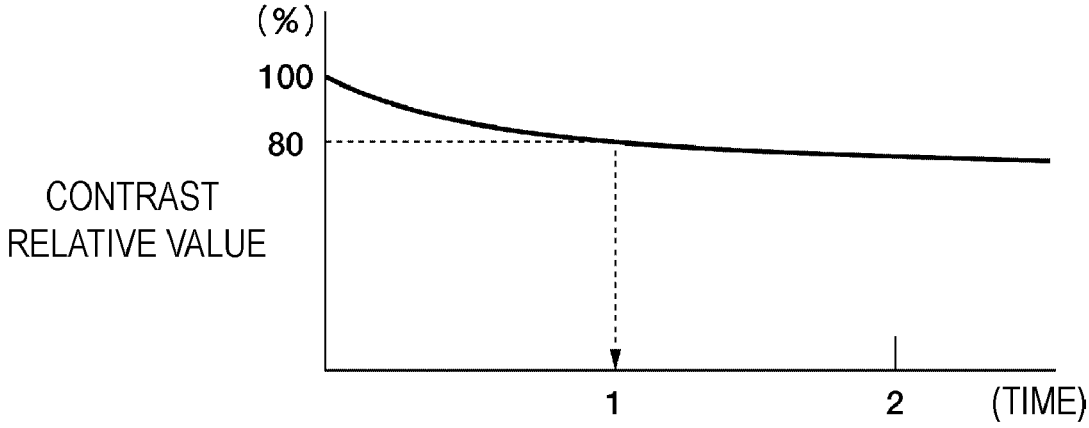
FIG. 8 is an explanatory diagram showing an example of a time-lapse change of display holding performance of an electrophoretic device.

When display refreshing operations are repeatedly performed, the display refreshing operations can be performed at an interval that is determined in consideration of the display holding performance of an electrophoretic dispersed system used and a desired display quality (acceptable quality). More specifically, the display refreshing operations can be performed at an interval that is shorter than a period of time in which the display holding performance of the electrophoretic dispersed system included in the electronic watch 1 is reduced to an unacceptable level. For example, when the display holding performance of the electrophoretic dispersed system included in the electronic watch 1 is represented by a contrast relative value shown in FIG. 8 and up to a 20% reduction of the contrast relative value is acceptable, the 20% reduction of the contrast relative value is achieved in about an hour, as is clear from the graph of FIG. 8. Thus, if display refreshing operations are performed at an interval of an hour or less, the display holding performance can always be maintained within an acceptable range.

In addition, as described above, when a display refreshing interval is determined by calculating a period of time in which the display holding performance is reduced to an unacceptable level, it is desirable that the display refreshing interval be set to be slightly shorter than the calculated period of time. If the display refreshing operations are performed at an interval that is slightly shorter than the calculated period of time, the display performance can always be maintained within an acceptable range, and at the same time, the number of display refreshing operations can be reduced to a minimum. Thus, unnecessary power consumption can be prevented.

Generally, the display holding performance of an electrophoretic dispersed system changes with the passage of time. Thus, a display refreshing interval may be determined in consideration of a change in the display holding performance. Such a configuration can be realized by, for example, the controller 21 processing display holding performance information, acquiring from the display holding performance information a period of time in which the display holding performance is reduced to an unacceptable level, determining a display refreshing interval based on the acquired period of time, and applying voltages to an electrophoretic element at the determined interval.

In contrast, a constant display refreshing interval may be set, irrespective of the deterioration speed of the display holding performance of a dispersed system, and a high voltage may be applied or a voltage may be applied for a long period of time so that the display holding performance is not reduced to an unacceptable level before the next refreshing operation is performed. For example, if a refreshing operation is performed every hour, a voltage large enough for maintaining display for an hour can be applied. In this case, if the voltage to be applied is set to a value that exactly offsets the reduction of the performance in an hour or a value that largely offsets the reduction of the performance in an hour, the display holding performance can always be maintained within an acceptable range, and unnecessary power consumption can be avoided. In addition, in this case, a change in the display holding performance of the dispersed system with the passage of time can be considered.

For electrophoretic devices and electrophoretic device driving methods according to the embodiments of the invention, the electronic watch 1 has been described by way of example. However, the electrophoretic devices and the electrophoretic device driving methods according to the embodiments of the invention are not necessarily limited to the electronic watch 1. For example, the electrophoretic devices and the electrophoretic device driving methods according to the embodiments of the invention can also be applied to an electronic apparatus having clock display or the like, such as a display having different rewrite intervals.

Figure 9A:
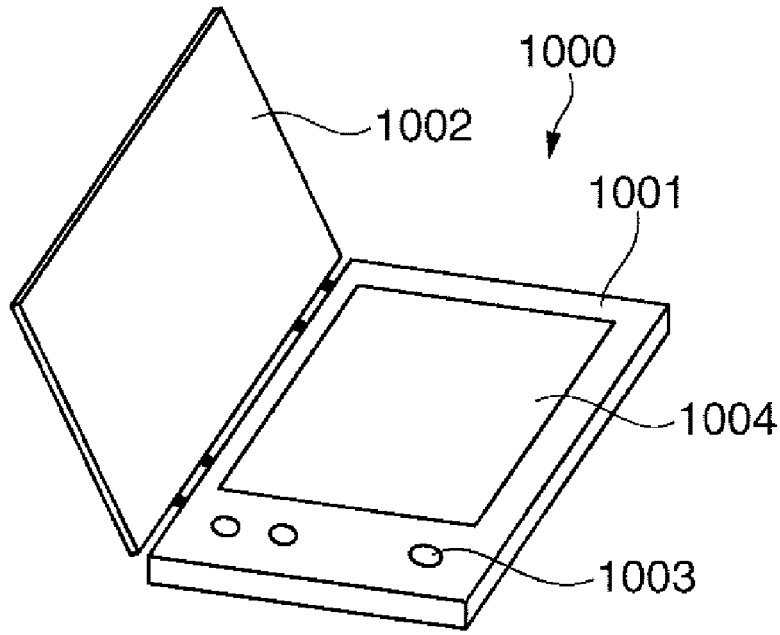
FIGS. 9A and 9B show examples of electronic apparatuses including an electrophoretic device.
Figure 9B:
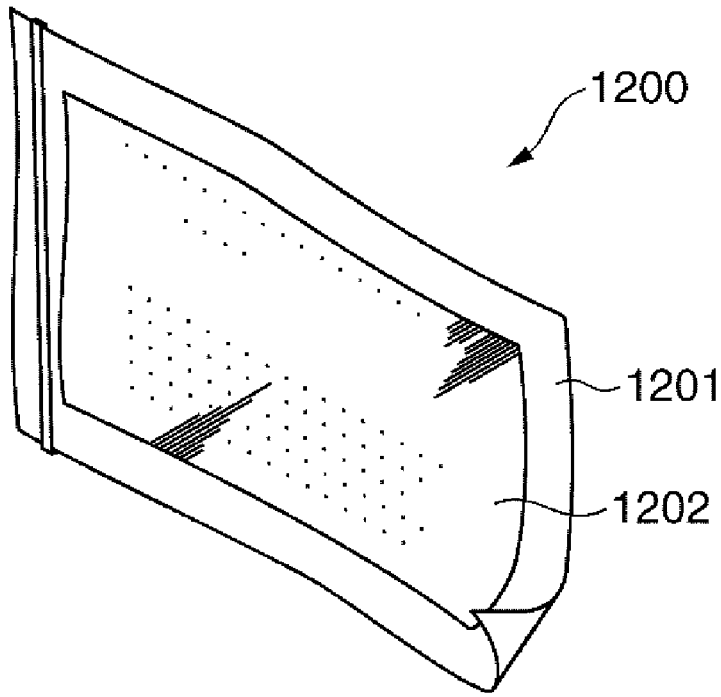

FIGS. 9A and 9B are perspective views for explaining specific examples of electronic apparatuses including an electrophoretic device. FIG. 9A is a perspective view of an electronic book 1000 as an example of the electronic apparatus. The electronic book 1000 includes a book-type frame 1001, a cover 1002 rotatably provided for the frame 1001 so as to be opened and closed, an operation section 1003, and a display section 1004 including the electrophoretic device according to any one of the foregoing embodiments. FIG. 9B is a perspective view of electronic paper 1200 as an example of the electronic apparatus. The electronic paper 1200 includes a main body section 1201 including a rewritable sheet having a feel and flexibility similar to those of paper and a display section 1202 including the electrophoretic device according to any one of the foregoing embodiments. The electronic apparatus including the electrophoretic device is not limited to the electronic book 1001 or the electronic paper 1200. The electronic apparatus including the electrophoretic device can be widely applied to any apparatuses utilizing a visual change in color tone caused by movement of charged particles. For example, the electronic apparatus including the electrophoretic device can also be applied to an object belonging to a fixed property, such as a wall surface to which an electrophoretic film is attached, or an object belonging to a moving body, such as a vehicle, a flying vehicle, or a ship.

The invention is not limited to the foregoing embodiments. Various changes can be made to the invention without departing from the scope of the invention. For example, although an active-matrix structure has been explained as a circuit structure of an electrophoretic device, the electrophoretic device does not necessarily have such a circuit structure. For example, a driving method according to any of the foregoing embodiments can be applied to an electrophoretic device having a passive-matrix circuit structure or an electrophoretic device having a so-called segment-direct drive circuit structure in which a controller individually applies a driving voltage to each pixel electrode.

What is claimed is:

1. A method for driving an electrophoretic device, the method comprising:

providing the electrophoretic device including:

a display region including a plurality of electrophoretic elements each including electrophoretic particles; and a first electrode and a second electrode having at least one of the plurality of electrophoretic elements disposed therebetween, wherein the display region is rewritten during a plurality of rewrite periods, the plurality of rewrite periods being spaced apart by different rewrite intervals, the rewrite intervals including a first rewrite interval and a second rewrite interval that is shorter than the first rewrite interval, and applying a second voltage to a second electrophoretic element which is rewritten during a second rewrite period subsequent to the second rewrite interval, the second voltage being lower than a first voltage applied to a first electrophoretic element which is rewritten during a first rewrite period subsequent to the first rewrite interval.

2. A method for driving an electrophoretic device, the method comprising:

providing the electrophoretic device including:

a display region including a plurality of electrophoretic elements each including electrophoretic particles; and a first electrode and a second electrode having at least one of the plurality of electrophoretic elements disposed therebetween, wherein the display region is rewritten during a plurality of rewrite periods, the plurality of rewrite periods being spaced apart by different rewrite intervals, the rewrite intervals including a first rewrite interval and a second rewrite interval that is shorter than the first rewrite interval, applying a first voltage to a first electrophoretic element for a first rewrite period subsequent to the first rewrite interval, and applying a second voltage to a second electrophoretic element for a second rewrite period subsequent to the second rewrite interval, the second rewrite period being shorter than the first rewrite period.

3. The method according to claim 2, wherein the second voltage is applied for the second rewrite period by dividing the first and second voltages into a plurality of pulses and by applying more of the pulses to the first electrophoretic element than to the second electrophoretic element.

4. The method according to claim 2, wherein an amplitude of the first voltage is equivalent to an amplitude of the second voltage.

5. A method for driving an electrophoretic device, the method comprising:

providing the electrophoretic device including:

a display region including a plurality of electrophoretic elements each including electrophoretic particles; and a first electrode and a second electrode having at least one of the plurality of electrophoretic elements disposed therebetween, wherein the display region includes a first unit of display and a second unit of display, the first unit of display and the second unit of display being rewritten during a plurality of rewrite periods, the plurality of rewrite periods being spaced apart by different rewrite intervals, the first unit of display being rewritten during a first rewrite period subsequent to a first rewrite interval, the second unit of display being rewritten during a second rewrite period subsequent to a second rewrite interval that is shorter than the first rewrite interval; and controlling a driver to apply a voltage only to an electrophoretic element included in the first unit of display to perform a display refreshing operation for the first unit of display.

6. The method according to claim 5, wherein:

the display refreshing operation is repeatedly performed; and the display refreshing operation is performed at an interval that is shorter than a period of time in which a display holding performance of the electrophoretic elements is reduced to a given level.

7. The method according to claim 5, wherein:

the display refreshing operation is repeatedly performed; and during each display refreshing operation, a selected voltage is applied that prevents a display holding performance of the electrophoretic elements from reducing to a given level before the next display refreshing operation is performed.

8. The method according to claim 5, wherein:

the display refreshing operation is repeatedly performed; and in each display refreshing operation, a selected voltage is applied for a period of time that prevents a display holding performance of the electrophoretic elements from reducing to a given level before the next display refreshing operation is performed.

9. An electrophoretic device comprising:

a display region including a plurality of electrophoretic elements each including electrophoretic particles;

a first electrode and a second electrode having at least one of the plurality of electrophoretic elements disposed therebetween;

a driver that drives the electrophoretic elements by applying voltages to the electrophoretic elements; and a controller controlling the driver, wherein the controller is adapted to control the driver so that the display region is rewritten during a plurality of rewrite periods, the plurality of rewrite periods being spaced apart by different rewrite intervals, the rewrite intervals including a first rewrite interval and a second rewrite interval that is shorter than the first rewrite interval, and wherein the controller is adapted to control the driver so that the driver:

applies a first voltage to a first electrophoretic element for a first rewrite period subsequent to the first rewrite interval, and applies a second voltage to a second electrophoretic element for a second rewrite period subsequent to the second rewrite interval, the second voltage being lower than the first voltage.

10. An electronic apparatus comprising the electrophoretic device as set forth in claim 9.

11. An electronic watch comprising the electrophoretic device as set forth in claim 9, wherein the first and second electrophoretic elements are located in display areas selected from a group including a month display, a date display, an hour display, a minute display, and a second display.

12. An electrophoretic device comprising:

a display region including a plurality of electrophoretic elements each including electrophoretic particles;

a first electrode and a second electrode having at least one of the plurality of electrophoretic elements disposed therebetween;

a driver that drives the electrophoretic elements by applying voltages to the electrophoretic elements; and a controller controlling the driver, wherein the controller is adapted to control the driver so that the display region is rewritten during a plurality of rewrite periods, the plurality of rewrite periods being spaced apart by different rewrite intervals, the rewrite intervals including a first rewrite interval and a second rewrite interval that is shorter than the first rewrite interval, and wherein the controller is adapted to control the driver so that the driver:

applies a first voltage to a first electrophoretic element for a first rewrite period subsequent to the first rewrite interval, and applies a second voltage to a second electrophoretic element for a second rewrite period subsequent to the second rewrite interval, the second rewrite period being shorter than the first rewrite period.

13. The electrophoretic device according to claim 12, wherein the second voltage is applied for the second rewrite period by dividing the first and second voltages into a plurality of pulses and by applying more of the pulses to the first electrophoretic element than to the second electrophoretic element.

14. The electrophoretic device according to claim 12, wherein an amplitude of the first voltage is equivalent to an amplitude of the second voltage.

15. An electrophoretic device comprising:

a display region including a plurality of electrophoretic elements each including electrophoretic particles, wherein the display region includes a first unit of display and a second unit of display, the first unit of display being rewritten during a plurality of first rewrite periods, the plurality of first rewrite periods being spaced apart by a first rewrite interval that is longer than a predetermined period of time, the second unit of display being rewritten during a plurality of second rewrite periods, the plurality of second rewrite periods being spaced apart by a second rewrite interval that is shorter than the predetermined period of time;

a first electrode and a second electrode having at least one of the plurality of electrophoretic elements disposed therebetween;

a driver that drives the electrophoretic elements by applying voltages to the electrophoretic elements; and a controller adapted to control the driver to apply a voltage only to an electrophoretic element included in the first unit of display to perform a display refreshing operation for the first unit of display.

16. The electrophoretic device according to claim 15, wherein:

the display refreshing operation is repeatedly performed; and the display refreshing operation is performed at an interval that is shorter than a period of time in which a display holding performance of the electrophoretic elements are reduced to a given level.

17. The electrophoretic device according to claim 15, wherein:

the display refreshing operation is repeatedly performed; and during each display refreshing operation, a selected voltage is applied that prevents a display holding performance of the electrophoretic elements from reducing to a given level before the next display refreshing operation is performed.

18. The electrophoretic device according to claim 15, wherein:

the display refreshing operation is repeatedly performed; and during each display refreshing operation, a voltage is applied for a period of time that prevents a display holding performance of the electrophoretic elements from reducing to a given level before the next display, refreshing operation is performed.

19. A method for driving an electrophoretic device, the method comprising:

providing the electrophoretic device including a plurality of electrophoretic elements;

applying a first voltage to a first electrophoretic element included in a first unit of the electrophoretic device; and applying a second voltage to a second electrophoretic element included in a second unit of the electrophoretic device, wherein the first voltage is applied to the first electrophoretic element during a plurality of first rewrite periods, the plurality of first rewrite periods being spaced apart by first rewrite intervals, the second voltage is applied to the second electrophoretic element during a plurality of second rewrite periods, the plurality of second rewrite periods being spaced apart by second rewrite intervals, the first rewrite intervals are longer than the second rewrite intervals, and at least one of a rewrite period and a level of the first voltage differs from the second voltage.

20. The method according to claim 19, wherein:

the first voltage is higher than the second voltage.

21. The method according to claim 19, wherein:

the first rewrite periods are longer than the second rewrite periods.

22. A controller for an electrophoretic device including a display region having a plurality of electrophoretic elements each including electrophoretic particles, a first electrode and a second electrode having at least one of the plurality of electrophoretic elements disposed therebetween, and a driver that drives the electrophoretic elements by applying voltages to the electrophoretic elements, wherein the controller is adapted to control the driver so that the display region is rewritten during a plurality of rewrite periods, the plurality of rewrite periods being spaced apart by different rewrite intervals, the rewrite intervals including a first rewrite interval and a second rewrite interval that is shorter than the first rewrite interval, and wherein the controller is adapted to control the driver so that the driver:

applies a first voltage to a first electrophoretic element for a first rewrite period subsequent to the first rewrite interval, and applies a second voltage to a second electrophoretic element for a second rewrite period subsequent to the second rewrite interval, the second voltage being lower than the first voltage.

23. A controller for an electrophoretic device including a display region having a plurality of electrophoretic elements each including electrophoretic particles, a first electrode and a second electrode having at least one of the plurality of electrophoretic elements disposed therebetween, and a driver that drives the electrophoretic elements by applying voltages to the electrophoretic elements, wherein the controller is adapted to control the driver so that the display region is rewritten during a plurality of rewrite periods, the plurality of rewrite periods being spaced apart by different rewrite intervals, the rewrite intervals including a first rewrite interval and a second rewrite interval that is shorter than the first rewrite interval, and wherein the controller is adapted to control the driver so that the driver:

applies a first voltage to a first electrophoretic element for a first rewrite period subsequent to the first rewrite interval, and applies a second voltage to a second electrophoretic element for a second rewrite period subsequent to the second rewrite interval, the second rewrite period being shorter than the first rewrite period.

24. The controller according to claim 23, wherein an amplitude of the first voltage is equivalent to an amplitude of the second voltage.

25. A controller for an electrophoretic device including a display region having a plurality of electrophoretic elements each including electrophoretic particles, a first electrode and a second electrode having at least one of the plurality of electrophoretic elements disposed therebetween, and a driver that drives the electrophoretic elements by applying voltages to the electrophoretic elements, the display region including a first unit of display and a second unit of display, the first unit of display and the second unit of display being rewritten during a plurality of rewrite periods, the plurality of rewrite periods being spaced apart by different rewrite intervals, the first unit of display being rewritten during a first rewrite period subsequent to a first rewrite interval, the second unit of display being rewritten during a second rewrite period subsequent to a second rewrite interval that is shorter than the first rewrite interval, wherein the controller is adapted to control the driver to apply a voltage only to an electrophoretic element included in the first unit of display to perform a display refreshing operation for the first unit of display.

26. A method for controlling an electrophoretic display, the method comprising:

controlling a first area of the display by rewriting the first area periodically using a driving parameter set to a first value, wherein rewrites of the first area are spaced apart by a first rewrite interval; and controlling a second area of the display by rewriting the second area periodically using the driving parameter set to a second value, wherein rewrites of the second area are spaced apart by a second rewrite interval, wherein the first value is greater than the second value, wherein the first rewrite interval is longer than the second rewrite interval, and wherein the driving parameter is one of (i) a magnitude of a voltage or (ii) a time period for which the voltage is applied.

27. A method for controlling an electrophoretic display, the method comprising:

controlling a first area of the display by periodically rewriting the first area with new data, wherein rewrites of the first area are spaced apart by a first rewrite interval, and wherein the first rewrite interval is longer than a predetermined period of time;

controlling a second area of the display by periodically rewriting the second area with new data, wherein rewrites of the second area are spaced apart by a second rewrite interval, wherein the second rewrite interval is shorter than the predetermined period of time; and performing refresh operations on only the first area, wherein the refresh operations (i) preserve a display quality of previous data written to the first area and (ii) are performed periodically, wherein the refresh operations are spaced apart by a predetermined interval, wherein the predetermined interval is shorter than the predetermined period of time.

28. The method according to claim 27, wherein the predetermined period of time is based on a period of time after which the display quality of the previous data written to the first area would fall below a threshold quality level.

* * * * *